US011353043B2

(12) United States Patent
Welschinger et al.

(10) Patent No.: US 11,353,043 B2
(45) Date of Patent: Jun. 7, 2022

(54) CENTRIFUGAL PUMP FOR CONVEYING A FLUID

(71) Applicant: Sulzer Management AG, Winterthur (CH)

(72) Inventors: Thomas Welschinger, Radolfzell (DE); Torsten Johne, Aadorf (CH); Mike Singer, Winterthur (CH); Nitin Ugale, Neftenbach (CH)

(73) Assignee: SULZER MANAGEMENT AG, Winterthur (CH)

( * ) Notice: Subject to any disclaimer, the term of this patent is extended or adjusted under 35 U.S.C. 154(b) by 62 days.

(21) Appl. No.: 15/699,404

(22) Filed: Sep. 8, 2017

(65) Prior Publication Data

US 2018/0087532 A1 Mar. 29, 2018

(30) Foreign Application Priority Data

Sep. 23, 2016 (EP) ..... 16190413

(51) Int. Cl.
*F04D 29/62* (2006.01)
*F04D 7/06* (2006.01)
(Continued)

(52) U.S. Cl.
CPC ..... *F04D 29/628* (2013.01); *F04D 1/00* (2013.01); *F04D 7/06* (2013.01); *F04D 29/426* (2013.01);
(Continued)

(58) Field of Classification Search
CPC . F04D 29/628; F04D 1/00; F04D 7/06; F04D 29/426; F04D 29/445;
(Continued)

(56) References Cited

U.S. PATENT DOCUMENTS 3,044,684 A * 7/1962 Fullemann ..... F04D 17/125 415/199.2
3,926,783 A * 12/1975 Wolk ..... B01J 8/22 208/127
(Continued)

FOREIGN PATENT DOCUMENTS

CH 443000 A 8/1967
CH 650063 A5 6/1985
(Continued)

OTHER PUBLICATIONS

Extended European Search Report dated Mar. 10, 2017 in corresponding European Patent Application No. 16190413.1, filed Sep. 23, 2016.

*Primary Examiner* — Phutthiwat Wongwian
*Assistant Examiner* — Susan E Scharpf
(74) *Attorney, Agent, or Firm* — Global IP Counselors, LLP

(57) ABSTRACT

A centrifugal pump for conveying a fluid includes a housing having an inlet and an outlet for the fluid. An impeller is arranged in the housing for rotation in an axial direction to convey the fluid from the inlet to the outlet, a shaft extends in the axial direction for driving the impeller, and a stationary guide device for guiding the fluid from the impeller to the outlet is connected to the housing. A resilient compensating element is disposed between the housing and the guide device, is arranged around the shaft, and holds the guide device in a centered position to the impeller during a radial relative movement to the housing.

19 Claims, 6 Drawing Sheets

(51) Int. Cl.

| | |
|---|---|
| ***F04D 29/44*** | (2006.01) |
| ***F04D 1/00*** | (2006.01) |
| ***F04D 29/42*** | (2006.01) |
| ***F04D 13/06*** | (2006.01) |
| ***F04D 29/043*** | (2006.01) |
| ***F04D 29/22*** | (2006.01) |

(52) U.S. Cl.
CPC ..... *F04D 29/445* (2013.01); *F04D 29/448* (2013.01); *F04D 13/0606* (2013.01); *F04D 29/043* (2013.01); *F04D 29/22* (2013.01); *F05D 2230/642* (2013.01); *F05D 2260/38* (2013.01); *F05D 2300/50212* (2013.01)

(58) Field of Classification Search
CPC .... F04D 13/0606; F04D 29/043; F04D 29/22; F04D 29/448; F05D 2230/642; F05D 2260/38; F05D 2300/50212
USPC ..... 415/211.2
See application file for complete search history.

(56) References Cited

U.S. PATENT DOCUMENTS 4,251,183 A * 2/1981 Liu ..... F04D 17/122 138/39
4,344,737 A * 8/1982 Liu ..... F04D 29/441 415/199.1
4,566,850 A * 1/1986 Grzina ..... F04D 29/4286 415/128
5,207,560 A * 5/1993 Urban ..... F04D 7/06 277/411
6,471,468 B1 * 10/2002 Hartmann ..... F04D 7/06 415/135
6,568,904 B1 * 5/2003 Ueyama ..... F04D 29/668 415/199.2
8,252,169 B2 * 8/2012 MacArthur ..... C10G 1/002 208/403
9,920,839 B1 * 3/2018 LaPresti ..... F16J 15/40
2013/0301787 A1 * 11/2013 Fortino ..... G21C 15/25 376/392
2014/0341716 A1 * 11/2014 Sun ..... F01D 17/165 415/123
2019/0010952 A1 * 1/2019 Welschinger ..... F04D 29/628
2020/0340479 A1 * 10/2020 Felix ..... F04D 13/086

FOREIGN PATENT DOCUMENTS

| | | | | |
|---|---|---|---|---|
| CN | 1076991 | A | 10/1993 | |
| CN | 1355380 | A | 6/2002 | |
| CN | 1555439 | A | 12/2004 | |
| CN | 204577732 | U | 8/2015 | |
| DE | 518178 | C | 2/1931 | |
| EP | 0480261 | A1 | 4/1992 | |
| EP | 2492511 | A2 | 8/2012 | |
| EP | 3299626 | B1 | 8/2020 | |
| GB | 926187 | * | 5/1963 | ..... H02K 9/19 |
| GB | 926187 | A | 5/1963 | |
| RU | 2585994 | C2 | 6/2016 | |
| RU | 2589735 | C2 | 7/2016 | |

* cited by examiner

CENTRIFUGAL PUMP FOR CONVEYING A FLUID

CROSS-REFERENCE TO RELATED APPLICATION

This application claims priority to European Application No. 16190413.1, filed Sep. 23, 2016, the contents of which are hereby incorporated herein by reference.

BACKGROUND

Field of the Invention

The invention relates to a centrifugal pump for conveying a fluid.

Background of the Invention

Centrifugal pumps are used for many different applications, for example in the oil and gas industry, in energy generation, in the water industry or in the pulp and paper industry, to mention only a few examples. There are also applications, in which the fluid conveyed by the pump has extremely high or very low temperatures.

An example for cryogenic temperature applications is conveying of liquefied natural gas (LNG: liquefied natural gas), the fluid (LNG) having temperatures in the range of −160° C.

High-temperature applications are found, for example, in energy production in thermal power plants. Here, so-called boiler circulation pumps are used to circulate heat transfer media, for example water, in the primary circuit of the power plant. In doing so, the heat transfer media can have temperatures of 400° C. or more.

SUMMARY

A further application area with very high fluid temperatures is the energy generation by solar power, especially by CSP (concentrated solar power) technology. In such systems, mirrors or lenses are used in order to focus the sunlight, which is collected over a large area, to a small area, for example to the top of a central tower, where the concentrated sunlight heats a heat transfer fluid (HTF), which is subsequently used for the generation of steam, which drives turbines for energy generation. A melted salt is generally used as heat transfer fluid, which salt already has a temperature of 350° C., for example, at the low-temperature side. The heat transfer fluid may have temperatures of up to 600° C. or even more at the high-temperature side. Here too, centrifugal pumps are used to circulate this very hot heat transfer fluid.

A further example for high-temperature applications are pumps, which are used for fluidized bed process or ebullated bed process) in the hydrocarbon processing industry. These processes, for example, help to clean heavy hydrocarbons, for example heavy oil or refinery waste, or to break them into better usable more volatile hydrocarbon. This is often done by applying the heavy hydrocarbons with hydrogen, wherein the mixed components are fluidized in a reactor and the heavy hydrocarbons are broken there by catalysts. In order to circulate the process fluid, which is usually composed of heavy hydrocarbons, in the ebullated bed reactor or in the fluidized bed reactor, special pumps are used, for which the term ebullating pump was established. These ebullating pumps are usually circulating pumps for the process fluid directly at the reactor and are designed due to process requirements in such a manner, that the pump is arranged vertically above the drive. Ebullating pumps have to work as reliably as possible under extremely challenging circumstances and for a long period in permanent operation. For the process fluid is typically under a very high pressure of 200 bar or more, for example, due to process requirements, and has a very high temperature of more than 400° C., for example 460° C.

Such applications, wherein the fluid to be conveyed has very high or very low temperatures, involve some challenges with respect to a suitable design of a centrifugal pump. Due to the high or low temperatures of the fluid, respectively, thermal effects arise, which have to be considered.

These are, for example, high temperature gradients in the pump, because for one thing, parts of the pump are in direct physical contact with the hot or very cold fluid, as for example the impeller and then again parts of the pump are in direct physical contact with the ambient temperature.

Furthermore, very extensive temperature transients can arise, in particular when starting the pump as long as it has not yet reached its operating point, or when shutting down the pump, especially in the event of an emergency shutdown. In such an emergency shutdown it may be necessary, for example, that the temperature of the fluid has to be lowered by more than 100° C. within a short time.

Such temperature gradients or temperature transients can cause enormous thermal stresses in the pump, which are due to the different thermal elongation of diverse components. However, it is not even necessary, that the diverse components of the pump have greatly different coefficients of thermal expansion, for different thermal elongations can arise in the components alone by the geometry or by the different masses of the components or by strong temperature gradients, which thermal elongations can result in significant stresses. Of course, this problem can be even more pronounced, if the components of the pump are manufactured from different materials, which have significantly different coefficients of thermal expansion, for example, if the guide device is made of a material different from the housing.

A concrete problem caused by such thermal effects is, that the centering of the impeller with respect to the guide device is lost or is no longer ensured, respectively. A very narrow gap is usually disposed between the area of the impeller facing the inlet and the area of the impeller (diffusor) or of the housing surrounding the latter, in the radial direction. This gap or this clearance, respectively, is intentionally kept very small, particularly in order to avoid an excessive backflow of the fluid from the high pressure side to the inlet of the pump. Due to this small gap or clearance, respectively, it is very important, that the impeller is centered as accurately as possible. If deformation arises due to different thermal expansions of the housing and of the guide device, so that the impeller loses its centricity, there is a significant risk, that the impeller directly contacts the guide device, which can result in serious damages to the impeller or to the pump, respectively.

In principle, it would be possible to enlarge this gap or the clearance, respectively, so much with respect to the radial direction, that such a contact between impeller and guide device is avoided, but such a measure would adversely affect the conveyor capability and the hydraulic efficiency or the degree of efficiency of the pump, respectively, to a great extent.

Therefore, it is an object of the invention to provide a centrifugal pump for conveying a fluid, which centrifugal pump is suitable for conveying very hot or very cold fluids and in which a decentering of the impeller caused by thermal effects is effectively prevented.

The object of the invention meeting this problem is characterized by the features disclosed herein.

According to an embodiment of the invention, a centrifugal pump for conveying a fluid is proposed, with a housing having an inlet and an outlet for the fluid, with an impeller arranged in the housing for rotation about an axial direction, with which impeller the fluid can be conveyed from the inlet to the outlet, with a shaft for driving the impeller, which shaft extending in the axial direction, as well as a stationary guide device for guiding the fluid from the impeller to the outlet, which guide device is connected to the housing, wherein a resilient compensating element is disposed between the housing and the guide device, which compensating element is arranged around the shaft and which can hold the guide device in a centered position to the impeller during a radial relative movement to the housing.

Usually, the impeller is centered with respect to the housing by the bearings and in particular by the radial bearings, with which the shaft bearing the impeller is supported and which are fixed with respect to the housing. The guide device is attached to the housing and arranged in such a manner, that it is centered above the housing with respect to the impeller.

Regarding the operating state of the pump, if different thermal expansions of the housing, on the one hand, and of the guide device connected to the housing, on the other hand, arise, this difference is compensated by a deformation of the resilient compensating element, so that the guide device stays in its centered position to the impeller. The relative displacement due to different thermal expansion between the housing and the guide device, which displacement is a radial relative movement between the housing and the guide device, is compensated by the compensating element, so that a decentering of the guide device to the impeller is avoided.

It is preferred that the compensating element is designed annularly with regard to practical aspects and to a particularly simple assembling of the centrifugal pump. Then, the compensating element is a ring, which can be arranged in a simple way around the shaft between the guide device and the housing during assembly.

According to a preferred embodiment, the compensating element comprises a first and a second contact surface, the first contact surface abutting against the guide device ant the second contact surface abutting against the housing, wherein the first contact surface and the second contact surface are arranged offset to each other with respect to the axial direction. In doing so, the compensating element particularly contacts the guide device only with the first contact surface and the housing only with the second contact surface with respect to the radial direction. The compensation function can be realized in a particularly simple manner by this measure, because both contact surfaces can move towards or away from one another with respect to the radial direction, in order to compensate radial relative movements between the guide device and the housing in such a manner.

With regard to practical aspects, it is an advantageous embodiment, the compensating element comprising a first transverse leg for contacting the guide device as well as a second transverse leg for contacting the housing, wherein the first transverse leg and the second transverse leg are connected to each other by a longitudinal leg extending in the axial direction.

The main function of the compensating element is to ensure the maintenance of the centered position of the guide device with respect to the impeller in the case of radial relative movements, thermally induced, between the guide device and the housing, for example in the case of displacement of the housing relative to the guide device in the radial direction. Thereby, this relative displacement can be compensated by a deformation of the connecting elements, via which the guide device is connected to the housing. These connecting elements typically comprise screws or bolts. Here, relatively strong mechanical stresses can arise in the connecting elements, for example by shearing stresses or bending stresses. In order to reduce or to avoid these mechanical loads, it is a particularly preferred measure to provide a plurality of connecting elements fixing the guide device to the housing with respect to the axial direction, wherein each connecting element is designed in such a manner, that it allows radial relative movement between the housing and the guide device. Regarding such a design, the guide device is supported in a quasi-floating manner with respect to the housing in the radial direction, thus the guide device can be moved or displaced, respectively, with respect to the housing in the radial direction.

According to a preferred embodiment, each connecting element comprises a sleeve in each case for this purpose, which sleeve is arranged in an axial bore in the housing or in the guide device as well as a fixing means (device) for fixing the guide device, wherein the fixing device extends through the sleeve and the sleeve having an outer diameter, which is smaller than the inner diameter of the axial bore, so that an annular gap is formed between the sleeve and the wall limiting the axial bore. Therefore, the guide device can be securely fixed to the housing with respect to the axial direction, while the clearance, realized by the annular gap, allows radial relative movement between the housing and the guide device. The fixing device preferably is a screw, particularly an expansion screw or a thread bolt.

It is a preferred measure, that each sleeve has a length in the axial direction, which is larger than the length of the axial bore, in which the sleeve is arranged and each sleeve having a flange at one of its axial ends, the flange having an outer diameter, which is larger than the inner diameter of the respective axial bore in which the sleeve is arranged. Thus, each fixing device, for example each screw or each thread bolt connecting the housing to the guide device, can be clamped by a nut or another safety agent, wherein the nut is supported on the respective flange, in order to ensure a secure and reliable fixing of the guide device in the axial direction.

Particularly preferred, each sleeve is designed in such a manner, that an axial gap is formed between the flange and the housing or the guide device with respect to the axial direction, in which the respective axial bore is provided, so that abutting of the flange on the housing or on the guide device is avoided. Based on the fact that the flange does not rest on the housing (or on the guide device, depending on which of both parts the axial bore is provided) due to the axial gap, there is no need to overcome any static frictional force or dynamic frictional force between the flange and the housing (or the guide device, respectively) in the case of a relative displacement of the housing to the guide device, which is particularly advantageous with regard to the mechanical load.

In a preferred design, the impeller and/or the guide device are made of a different material than the housing. As the solution, according to the invention allows to compensate different thermal expansions, in particular of the housing and of the guide device, the guide device and/or the impeller can also be made of a different material than the housing.

Specifically, also two materials with greatly different specific coefficients of thermal expansion can be used. Depending on the application, sometimes it is desirable, namely due to technical reasons, to manufacture the impeller and/or the guide device from a different material than the housing. For example, this is advantageous for those applications in which chemically aggressive or highly abrasive fluids are conveyed. Thus, a material can be chosen for the impeller and/or the guide device, which material is optimized with regard to its resistance to the fluid to be conveyed, while a different material can be chosen for the housing, for example a more cost-effective.

For some applications, a design of the centrifugal pump is preferred in which a drive unit is provided for driving the impeller, which drive unit is connected to the shaft, whereby the drive unit is arranged in the housing. Such designs are particularly advantageous for applications, in which the pump is entirely or completely immersed in a liquid, e.g. water, or when the pump is operated in places which are difficult to access or in harsh conditions or ambient conditions. Furthermore, it is usual to integrate the drive unit in the housing, when shaft seals, as for example mechanical seals, cannot be used or cannot be used in a meaningful way for sealing the shaft feedthrough from the housing to an externally arranged drive unit.

In a preferred embodiment, the housing is a pressure housing, preferably for an operating pressure of at least 200 bar.

In particular, for applications in the high-temperature range it is advantageous, if the centrifugal pump is designed for a fluid having a temperature of more than 400° C.

An embodiment according to the invention is in particular also suitable for such pumps, in which a drive unit is provided, which is arranged below the impeller with respect to the vertical. In relation to the normal operating position of the pump. This means that the pump is arranged above the drive unit. Thereby, the drive unit is preferably arranged in the housing of the centrifugal pump.

It is a further preferred measure, if the impeller is designed as a radial impeller.

It is a particularly important embodiment for practical use, if the centrifugal pump is designed as a boiler circulation pump or as an ebullating pump for the circulation of a process fluid.

Further advantageous measures and embodiments of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
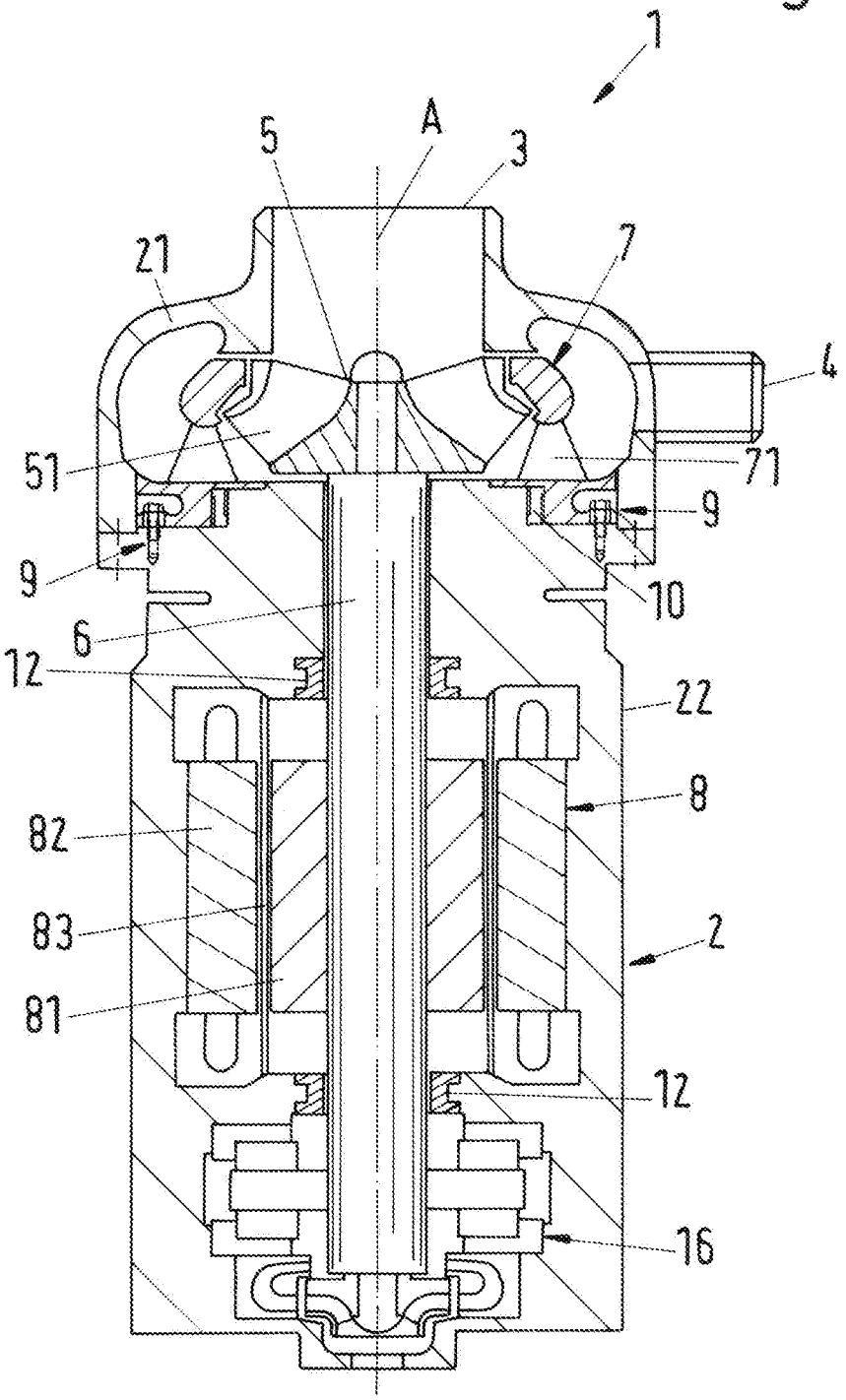
FIG. 1 is a partially schematic sectional view of an embodiment of a centrifugal pump according to the invention.

FIG. 1 illustrates in a partially schematic sectional view an embodiment of a centrifugal pump according to the invention for conveying a fluid, the pump being entirely indicated with the reference sign 1. The centrifugal pump 1 has a housing 2, which has an inlet 3 and an outlet 4 for the fluid, an impeller 5 arranged in the housing 2 for rotation about an axial direction A, which is defined by the set rotation axis of the centrifugal pump 1, a shaft 6 for driving the impeller 5 extending in the axial direction A, as well as a stationary guide device 7 being connected to the housing 2 and guiding the fluid conveyed by the impeller 5 to the outlet 4. The term "diffuser" is also common to the guide device 7.

FIG. 1 illustrates the embodiment in a section along the axial direction A.

Below, a direction vertical to the axial direction is described as radial direction.

In the embodiment described here, the housing 2 comprises an upper housing part 21, as well as a lower housing part 22, which are connected in a sealing manner to each other by screw connections, not illustrated, or by a flange connection.

In the embodiment described here, the centrifugal pump 1 also comprises a drive unit (driver) 8 for driving the impeller 5, which drive unit 8 is connected to the shaft 6, on which the impeller 5 is arranged, wherein the drive unit 8 is arranged in the housing 2 of the centrifugal pump 1. It is understood, that the invention is not limited to such embodiments in which the drive unit 8 is integrated in the housing 2 of the pump 1. In fact, it is also possible, that the drive unit 8 is arranged as a separate device outside the housing 2 of the centrifugal pump 1.

Below, it is referred to the application important for practice with an exemplary nature, that the embodiment of a centrifugal pump 1 according to the invention described here is designed as an ebullating pump. As mentioned above, ebullating pumps are pumps which are used for fluidized bed process or ebullated bed process in the hydrocarbon processing industry. These processes are used to clean heavy hydrocarbons, which remain in the bottom of fractionating columns, for example in the oil refinery, for example to desulphurize and/or to break into lighter hydrocarbons, which then can be used more economical as distillates. An example heavy hydrocarbons mentioned here can be heavy oil, which remains in the refinery of oil. In a method, according to the state of the art, the original substance, that is to say the heavy hydrocarbons as heavy oil, for example, is heated, mixed with hydrogen and then introduced as a process fluid into the fluidized bed reactor or into the ebullated bed reactor. Then, the cleaning or the breaking-up, respectively, of the process fluid takes place in the reactor by catalysts, which are kept in suspension in the reactor, in order to ensure contact as close as possible with the process fluid. For supplying the reactor with the process fluid or for circulating the process fluid, respectively, is used an ebullating pump, which is typically mounted directly to the reactor.

As a result of the process, the process fluid is under a very high pressure, for example of at least 200 bar, and at a very high temperature, for example above 400° C., the ebullating pump has to be designed for such pressures and temperatures. In doing so, in particular the housing 2 of the centrifugal pump 1, which housing 2 encloses the impeller 5 and the drive unit 8, is designed as a pressure housing, which can safely withstand these high operating pressures of, for example, 200 bar or more. Additionally, the ebullating pump 1 also is designed in such a manner, that it can convey a hot process fluid without risk, which process fluid having a temperature of more than 400° C. The ebullating pump 1 usually is arranged in such a manner, that the shaft 6 extends in the vertical direction, wherein the impeller 5 is arranged at the top. This customary use position, is also illustrated in FIG. 1.

Although the design of the centrifugal pump 1 is referred to as an ebullating pump, it is understood, however, that the invention is not limited to such designs or applications, respectively. The centrifugal pump 1 according to the invention can also be designed for other applications, for example as an immersion pump, which is entirely or partially immersed in a liquid, e.g. water, in the operating state. The centrifugal pump 1 can also be designed as a horizontal pump, in which the shaft 6 extends in the horizontal direction. In particular, the invention is suitable for such centrifugal pumps, which are used for conveying very hot fluids of, for example more than 400° C., as well as for centrifugal pumps 1, which are used for conveying very cold fluids of, for example −160° C. or even lower temperatures. Examples mentioned here are boiler circulation pumps, with which are circulated in thermal power plants for energy generation of the heat transfer fluids, especially of the heat transfer fluids in the primary circuit, or pumps, which are used in the field of energy generation by CSP (concentrated solar power) technology for conveying the heat transfer fluid (HTF: heat transfer fluid), usually a melted salt, or pumps in cryoindustry or cryotechnology, respectively, with which, for example, liquefied natural gas (LNG: liquefied natural gas) in the temperature range of, for example −160° C., is conveyed.

In the embodiment of the centrifugal pump according to the invention which pump is designed as ebullating pump, illustrated in FIG. 1, the impeller 5 is arranged above the drive unit 8 with respect to the normal use position, illustrated in FIG. 1. The impeller 5 comprising a number of vanes or blades 51, with which impeller the fluid is conveyed from the inlet 3, which is arranged here above the impeller 5, to the outlet 4, which is arranged here at the side of the housing 2. Here the impeller 5 is designed as closed impeller 5 in a manner known per se with a hub 53 and a cover plate 52 facing the inlet 3 (see FIG. 2), between which the blades 51 are arranged. In doing so, the cover plate 52 covers the blades 51, so that substantially closed channels for the fluid are formed between these blades.

In a manner known per se, the impeller 5 is surrounded by the stationary guide device 7, also referred to as diffusor, which is arranged externally around the impeller 5 with respect to the radial direction. The guide device 7 comprises a number of stationary guide vanes 71 in a manner known per se (see FIG. 2), with which the fluid conveyed by the impeller 5 is guided to the outlet 4 of the pump 1.

The stationary guide device 7 is mounted to the housing 2 via a plurality of connecting elements (connectors) 9 and here in particular connected to the lower housing part 22 of the housing 2.

Each connecting element 9 preferably comprises a fixing means or device (fixer) 91 including a thread (see FIG. 2), by which fixing device the guide device 7 is fixed to the housing 2. The fixing device 91 particularly is a screw connection, for example a screw or a (thread) bolt.

A drive unit 8 drives the impeller 5, which drive unit is designed here as an electrical canned motor in a manner known per se. The drive unit 8 comprises an internal rotor 81 as well as an external stator 82 surrounding the rotor 81. A can 83 is disposed between the rotor 81 and the stator 82, which can hermetically seal the stator 82 against the rotor 81 in a well known manner. The rotor 81 is connected torque-proof to the shaft 6, extending in the axial direction A, and on the other hand the shaft is connected torque-proof to the impeller 5, so that the impeller 5 can be driven by the drive unit 8.

With respect to the axial direction immediately above or immediately below the drive unit 8, a radial bearing 12 is disposed in each case for the radial bearing of the shaft 6. The impeller 5 is centered by the radial bearing 12 with respect to the housing 2. An axial bearing 16 is disposed for the shaft 6 below the lower radial bearing according to the description.

Due to the process, the fluid to be conveyed in the ebullating pump 1 has a very high temperature, which is in the range of 450° C., for example. This enormously high temperature causes very strong thermal loads in the pump 1. These thermal loads are based, for example, on the high temperature gradients in the pump 1, because, on the one hand, parts of the pump 1, as for example the impeller 5 or the guide device 7, are in direct physical contact with the hot fluid that flows through it, and on the other hand, parts of the pump, as for example at least parts of the housing 2 are in direct physical contact and thus in thermal contact with the ambience of the pump 1, wherein the ambient air is drastically lower—or drastically higher at low-temperature applications.

Additionally, very significant temperature transients can arise, in particular when starting the pump as long as it has not yet reached its operating point, or when shutting down the pump. Especially in the event of an emergency shutdown of the pump, for example if the catalyst fails in the reactor the temperature of the fluid has to be lowered by more than 100° C. within a short time, for example within a few minutes.

Such temperature gradients or temperature transients can cause enormous thermal stresses in the pump 1, which are based on, inter alia, different thermal elongation of various components, especially for one thing on the different thermal elongation of the housing 2, then again on the guide device 7, which is connected to the housing 2. However, it is not even necessary, that these different components such as the housing 2 and the guide device 7 have greatly different coefficients of thermal expansion, for different thermal expansions can arise in these components solely due to the geometry or due to the different masses of the components or due to strong temperature gradients, which can cause significant stresses. Of course, this problem can be even more pronounced, if the housing 2 of the pump 1 and the guide device 7 are manufactured from different materials, which have significantly different coefficients of thermal expansion.

Due to these different thermal expansions, there is the risk, that the centering of the guide device 7 to the impeller 5 is lost or is no longer ensured, respectively. As it can be seen in particular in the enlarged view of FIG. 2, only a very small clearance S in the form of an annular gap is disposed in the radial direction between the rotating cover plate 52 of the impeller 5 and the stationary guide device 7, via which clearance the fluid can flow back from the pressure side of the impeller 5 to the inlet 3. This annular gap or this clearance, respectively, is intentionally kept very small, particularly in order to avoid an excessive backflow of the fluid. Due to this small clearance S, it is very important, that the impeller 5 runs as accurately centered as possible with respect to the guide device 7. If deformation arises due to different thermal expansions of the housing 2 and of the guide device 7, so that the guide device 7 loses its centricity with respect to the impeller 5, there is a significant risk, that the rotating impeller 5 directly contacts the stationary guide device 7, which can result in serious damages to the impeller 5 or to the pump 1, respectively.

That is the reason why, according to the invention, a resilient compensating element (compensator) is disposed between the housing 2 and the guide device 7, which compensating element is arranged around the shaft 6 and which can hold the guide device 7 in a centered position with respect to the impeller 5 during a radial relative movement, in particular in the case of a relative displacement between the housing 2 and the guide device 7.

Then, the different elongation between the housing 2 on the one hand, and the guide device 7 on the other hand is compensated by a corresponding deformation of the resilient compensating element 10.

Figure 2:
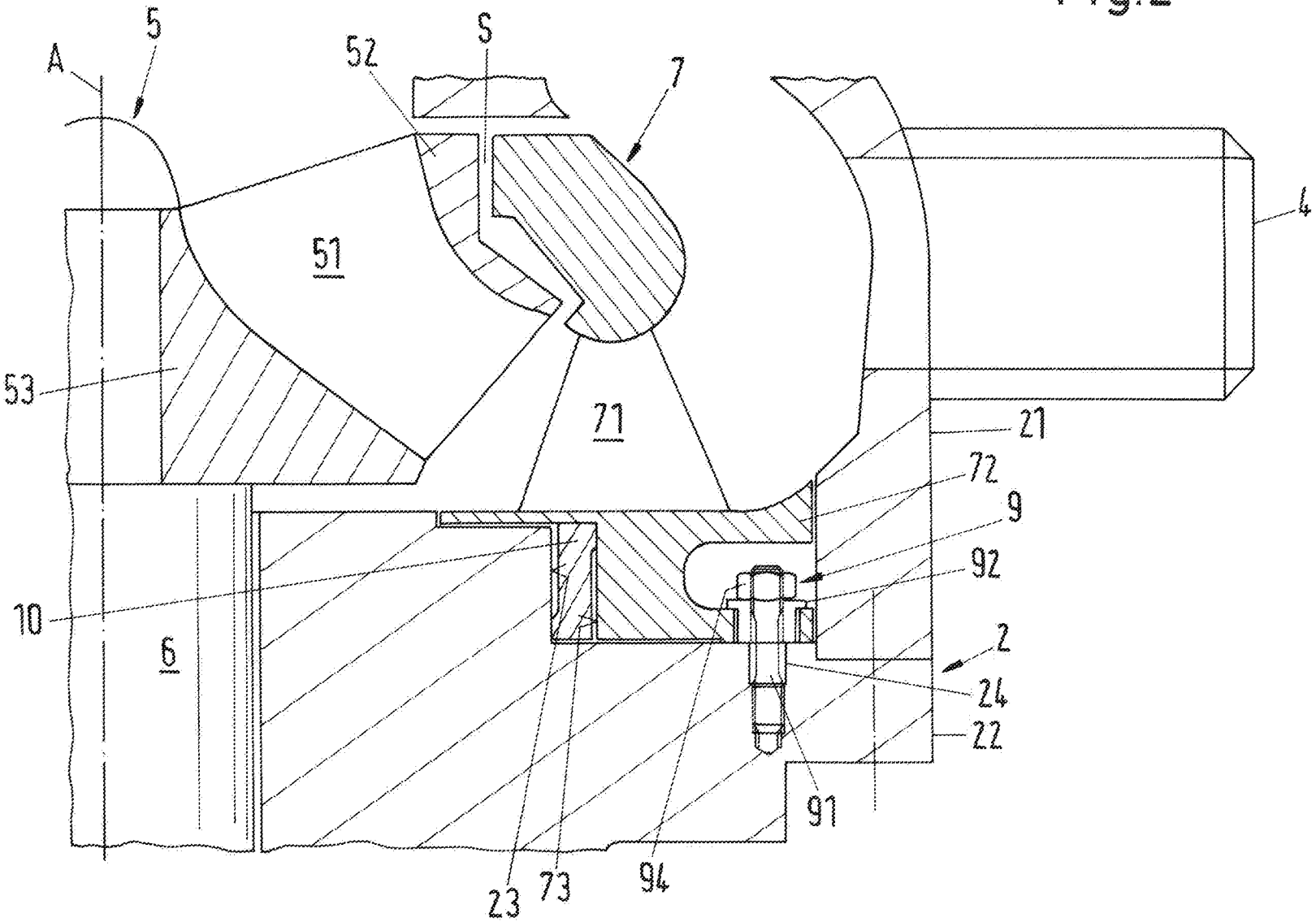
FIG. 2 is an enlarged sectional view of the connection between the housing and the guide device from FIG. 1.
Figure 3:
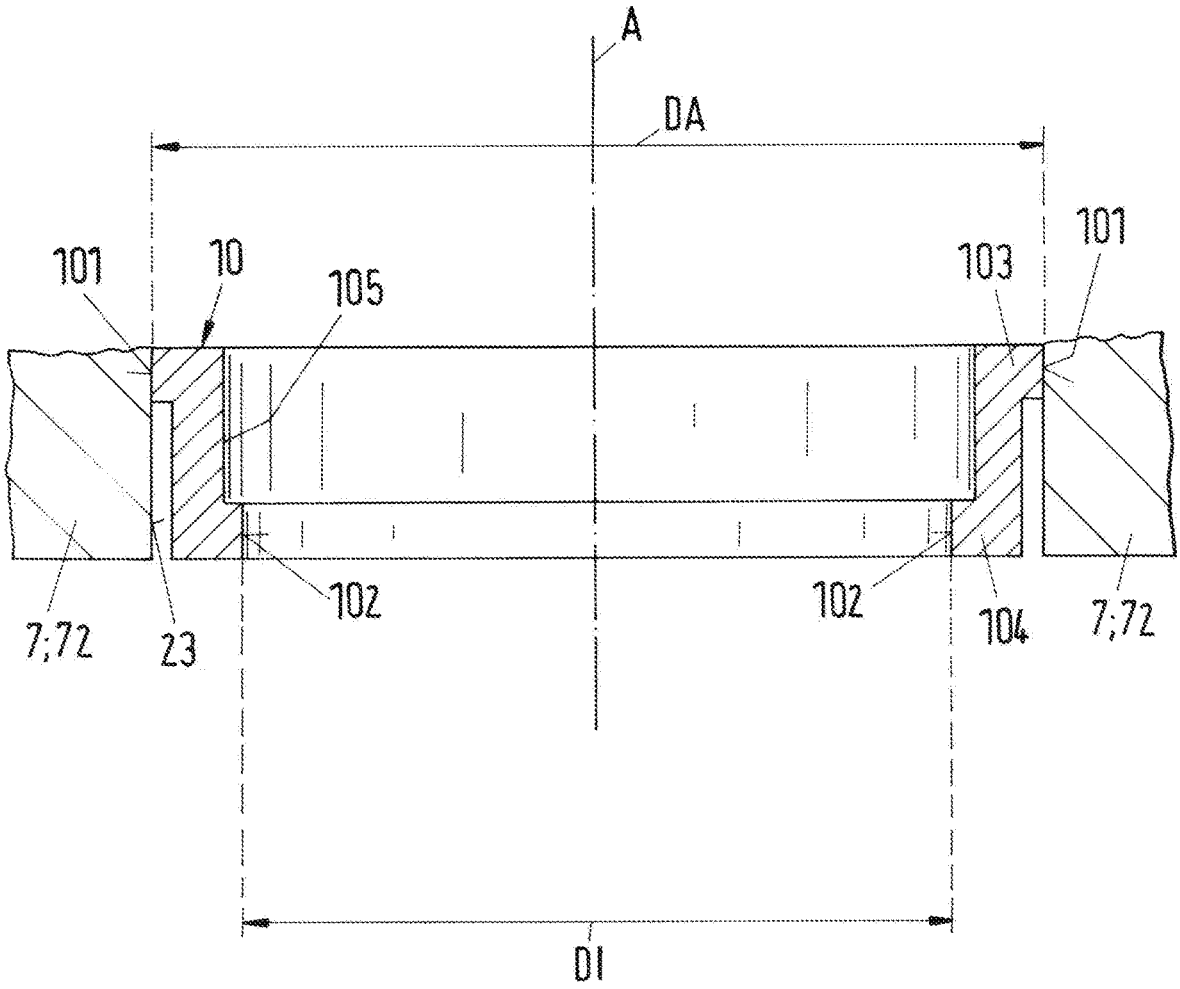
FIG. 3 is a sectional view of the compensating element.

For a better understanding, FIG. 2 illustrates an enlarged sectional view of the connection between the housing 2 and the guide device 7 with the resilient compensating element 10 arranged in between. The section takes place in the axial direction. FIG. 3 further illustrates a sectional view of the compensating element 10 in a section along the axial direction A. For a better overview, the guide device 7 is indicated in FIG. 3, while the housing 2 is not illustrated.

If, due to the described thermal effects, different elongations arise in the housing 2 and in the guide device 7 and specifically in the area in which the guide device 7 is connected to the housing 2, here the lower housing part 22, so the resilient compensating element 10 is deformed, whereby the relative displacement in the radial direction of the housing 2 with respect to the guide device 7 is compensated in this area, so that the guide device 7 remains in its centered position with respect to the impeller 5. Thus, the resilient compensating element 10 acts as a spring, with which relative movements in the radial direction are compensated between the housing 2 and the guide device 7, so that the guide device 7 remains centered with respect to the impeller 5.

In the embodiment described here, the resilient compensating element 10 is designed to be annular, especially as an axially symmetrical spring ring with respect to the axial direction. Suitable materials for the compensating element 10 are basically all materials, which are generally used for springs, for example spring steel. Spring steel is particularly distinguished by a significantly higher elastic limit compared to other steels. The compensating element 10 is preferably designed in such a manner with respect to its material properties and to its geometry, that it elastically deforms in the operating state of the pump 1, when stresses arise and that it returns to its original shape after the elimination of stresses. Preferably, a plastic deformation of the compensating element 10 is avoided, hence an exceeding of its elastic limit.

As it can be seen in particular in FIG. 1 and FIG. 2, the annular compensating element 10 is arranged symmetrically around the shaft 6 between the housing 2 and the guide device 7, in such a manner that the guide device 7 is in contact with the housing 2 via the compensating element 10 with respect to the radial direction.

The guide device 7 comprises a mounting foot 72 (see FIG. 2), by which the guide device 7 is connected to the housing 2. The mounting foot 72 comprises a radially internal annular surface 73, which is concentric with respect to the shaft 6 and thus axially symmetrical with respect to the axial direction A, on which annular surface the compensating element 10 is supported.

The housing 2, here the lower housing part 22, has an annular support surface 23, which is concentric with respect to the shaft 6 and thus axially symmetrical with respect to the axial direction A, on which annular support surface 23 the compensating element 10 is supported. The support surface 23 is arranged radially internal with respect to the annular surface 73, wherein the support surface 23 and the annular surface 73 are coaxial.

As it is particularly evident from FIGS. 2 and 3, the compensating element 10 has a first and a second contact surface 101 or 102, respectively, wherein the first contact surface 101 abuts on the guide device 7, namely on the annular surface 73 of the guide device 7, and wherein the second contact surface 102 abuts on the housing 2, namely on the support surface 23. The first and the second contact surface 101 or 102, respectively, are arranged offset to each other with respect to the axial direction. Hence, the compensating element 10 is designed in such a manner, that it contacts the guide device 7 only with the first contact surface 101 and the housing 22 only with the second contact surface 102 with respect to the radial direction.

For this purpose, the compensating element 10 has a substantially S-shaped cross-sectional area, that is to say the compensating element 10 has a first transverse leg 103 for contacting the guide device 7 as well as a second transverse leg 104 for contacting the housing 2, wherein the first transverse leg 103 and the second transverse leg 104 are connected to each other by a longitudinal leg 105 extending in the axial direction A. The first and the second transverse leg 103 or 104, respectively, extend in each case in the radial direction. The first transverse leg 103 comprises the first contact surface 101 and the second transverse leg 104 comprises the second contact surface 102.

Preferably, the annular compensating element 10 is measured in such a manner with respect to its outer diameter DA, that it can be inserted in the guide device 7 with an interference fit, so that first contact surface 101 is pre-clamped against the annular surface 73. The inner diameter DI of the annular compensating element 10 is measured in such a manner, that the compensating element 10 can still be mounted after being inserted into the guide device 7, that is in the pre-clamped state, that is to say the compensating element 10 can be arranged around the support surface 23 of the housing 2.

In the embodiment illustrated in FIG. 3, this means, that the outer diameter DA of the first transverse leg 103 is slightly larger in the unclamped state than the diameter of the space limited by the annular surface 73. The inner diameter DI of the second transverse leg 104 is measured in such a manner, that it is after inserting the compensating element 10 into the guide device 7, that is in the unclamped state of the compensating element 10, at least as large as the diameter of that part of the housing 2, which is limited by the support surface 23.

When different elongations of the housing 2 and of the guide device 7 arise in the operating state of the centrifugal pump 1, both contact surfaces 101 and 102 of the compensating element 10 are displaced relative to each other in the radial direction, wherein the radial relative movement between the housing 2 and the guide device 7 is compensated, so that the guide device 7 remains in its centered position with respect to the impeller 5.

Thus, the main function of the compensating element 10 is to ensure the maintenance of the centered position of the guide device 7 with respect to the impeller 5 in the case of radial relative movements, thermally induced, between the guide device 7 and the housing 2. As a rule, the relative displacement between the housing 2 and the guide device 7 can be compensated by a deformation of the connecting elements 9, via which the guide device 7 is connected to the housing 2. Hereby, relatively strong mechanical stresses can arise in the connecting elements 9, for example by shearing stresses or bending stresses. In order to reduce or to avoid these mechanical loads, it is a particularly preferred measure to provide a plurality of connecting elements 9, which fix the guide device 7 to the housing 2 with respect to the axial direction A, wherein each connecting element 9 is designed in such a manner, that it allows radial relative movement between the housing 2 and the guide device 7. Regarding such a design, the guide device 7 is supported in a quasi-floating manner with respect to the housing 2 in the radial direction, thus the guide device 7 can be moved or displaced, respectively, with respect to the housing 2 in the radial direction.

Figure 4:
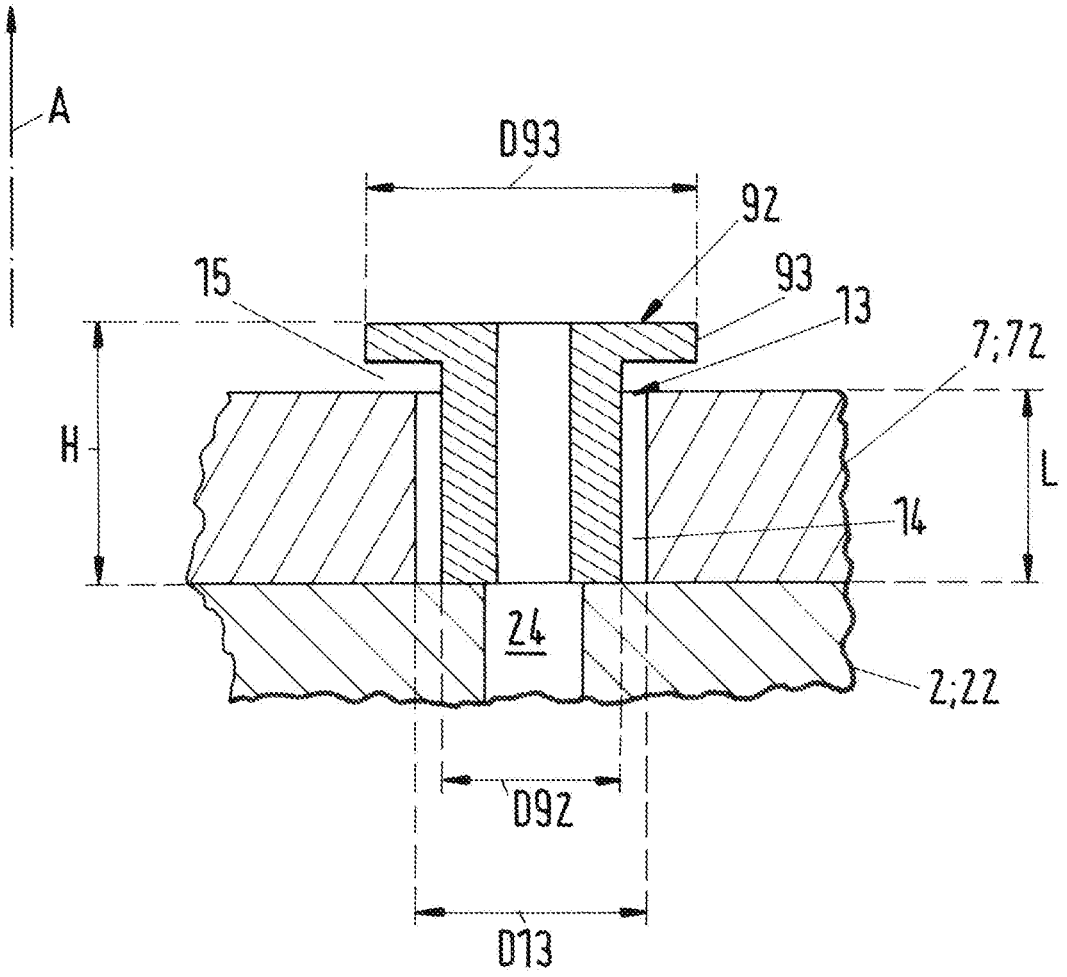
FIG. 4 is a sectional view of the connecting element (without a screw)

Such a preferred design of the connecting elements 9 is explained in more detail below with reference to FIG. 2 and FIG. 4. Thus, FIG. 4 illustrates a sectional view of the connecting element 9 in a section along the axial direction A, wherein the fixing device 91 is not illustrated in FIG. 4 for reasons of a better overview.

Each connecting element 9 comprises a sleeve 92, which is arranged in an axial bore 13 in the guide device 7, more precisely in the mounting foot of the guide device 7. Of course, deviating from the illustration in FIGS. 2 and 4 it is also possible in an analogously same way, that the axial bore 13, which takes the sleeve 92, is disposed in the housing 2.

The connecting element 9 further comprises the fixing device 91 for fixing the guide device 7 to the housing 2, wherein the fixing device 91 extends through the sleeve 92 into the housing 2 in the axial direction A. The fixing device 91 realizes preferably a screw connection and particularly preferred an expansion screw connection. For this purpose, the fixing device 91 preferably is a screw or a thread bolt or a stud bolt, especially preferred an expansion screw or an expansion stud bolt, as illustrated in FIG. 2. The expansion stud bolt 91 joins in a threaded hole 24 with its lower end (FIG. 2) in the housing 2 according to the description, which threaded hole aligns with the axial bore 13, but having a smaller inner diameter than the axial bore 13. The thread, disposed in the area of the lower end of the expansion stud bolt 91, joins in the thread of the threaded hole 24, so that the expansion stud bolt 91 is tightly connected to the housing 2.

The sleeve 92 has an outer diameter D92, which is smaller than the inner diameter D13 of the axial bore 13, so that an annular gap 14 is formed between the sleeve 92 and the wall limiting the axial bore 13, which annular gap extends in the axial direction A along the entire length L of the axial bore 13.

The sleeve 92 has a length H in the axial direction A, which length is larger than the length L of the axial bore 13. The sleeve 92 has a flange 93 at its upper axial end according to the illustration (FIG. 4), the flange having an outer diameter D93, which is larger than the inner diameter D13 of the axial bore 13. The sleeve 92 abuts on the housing 2 with its lower axial end according to the illustration (FIG. 4).

As it can be seen in particular in FIG. 4, the length H of the sleeve 92 is measured in such a manner, that an annular axial gap 15 is formed between the flange 93 and the guide device 7, in which the axial bore 13 is disposed, with respect to the axial direction A, so that abutting of the flange 93 on the guide device 7 is avoided.

In order to connect the guide device 7 to the housing 2, the expansion stud bolt 91, passing through the sleeve 92, is screwed in the threaded hole 24 in the housing 2. The upper end of the expansion stud bolt according to the illustration (FIG. 2), which also includes a thread, projects beyond the flange 93 in the axial direction A. A nut 94 is screwed on this end, which nut finally abuts on the flange 93. The guide device 7 is fixed to the housing 2 by tightening the nut 94 with respect to the axial direction A. Thereby, the expansion stud bolt 91 is preferably tensioned.

Thus, the guide device 7 is connected to the housing 2 by the interaction of the majority of connecting elements 9, wherein the guide device 7 is fixed with respect to the axial direction A. This is done here by the preferably tensioned expansion stud bolts 91 in interaction with the sleeve 92, on the one hand, abutting on the housing and on the other hand, forming the support surface for the nut 94 with its flange 93, with which nut the expansion stud bolt 91 can be tensioned. In this state, the guide device 7 is fixed with an axial clearance 15 with respect to the axial direction.

The guide device 7 is supported in a floating manner with respect to the housing 2 in the radial direction, due to the annular gap 14 in the axial bore between the sleeve 92 and the guide device 7. In spite of the fixing in the axial direction A, the guide device 7 can be moved with respect to the housing 2 in the radial direction. If a different elongation of the housing 2 on the one hand and of the guide device 7 on the other hand arises in the operating state of the pump 1, so the connecting elements 9 allow a relative displacement between the housing 2 and the guide device 7, due to the annular gap 14.

The axial gap 15 is also particularly advantageous for such a relative displacement, which axial gap is disposed between the flange 93 and the mounting foot 72 of the guide device 7. Because of the fact, the flange 93 having no direct physical contact to the mounting foot 92, thus not abutting on this, there is no need to overcome in the case of a relative displacement any static frictional forces or dynamic frictional forces, which would act on or with, respectively, the mounting foot 72, when the flange is rested or tensioned.

Here, it is particularly advantageous, that the connecting elements 9, fixing the guide device 7 to the housing 2 with respect to the axial direction A, are designed in such a manner, that they allow a radial relative movement between the housing 2 and the guide device 7 without an axial tensioning.

The solution according to the invention, with which thermally induced elongation effects can be compensated, is also suitable in particular for such embodiments, in which the impeller 5 and/or the guide device 7 is manufactured of a different material than the housing 2. For technical reasons, it can be advantageous to use a different material for the impeller 5 and/or the guide device 7 than for the housing 2.

The housing 2 is usually made of a steel or of a cast material such as cast iron. It is preferably for some applications, when the impeller 5 is made of a different material. As already mentioned, generally a chemically very aggressive fluid is conveyed with the ebullating pump, for example, which fluid may additionally have abrasive properties. Therefore, it may be desirable to manufacture the impeller 5 and the guide device 7, which are perfused by the fluid, of a different material with higher wear resistance, which is more resistant to the load collective by the fluid, and thus allowing a longer service life or longer maintenance intervals, respectively. This may be, for example, a material with a very good corrosion resistance or hot corrosion resistance, respectively. Particularly suitable for the impeller 5 and the guide device 7 of an ebullating pump, but also for other high-temperature applications, are nickel-base alloys, which are known under the trade name Inconel.

Therefore, Inconel is also advantageous, because it can be treated particularly well by methods for surface hardening, such as for example bonding. With regard to Inconel, the diffusion processes during bonding are much deeper inside the material, as when using other materials, for example austenitic steel, so that especially wear resistant surfaces can be generated by bonding.

It is understood, that for the specific design of the compensating element 10 numerous other variants are possible, of course than that illustrated in FIG. 3.

Figure 5:
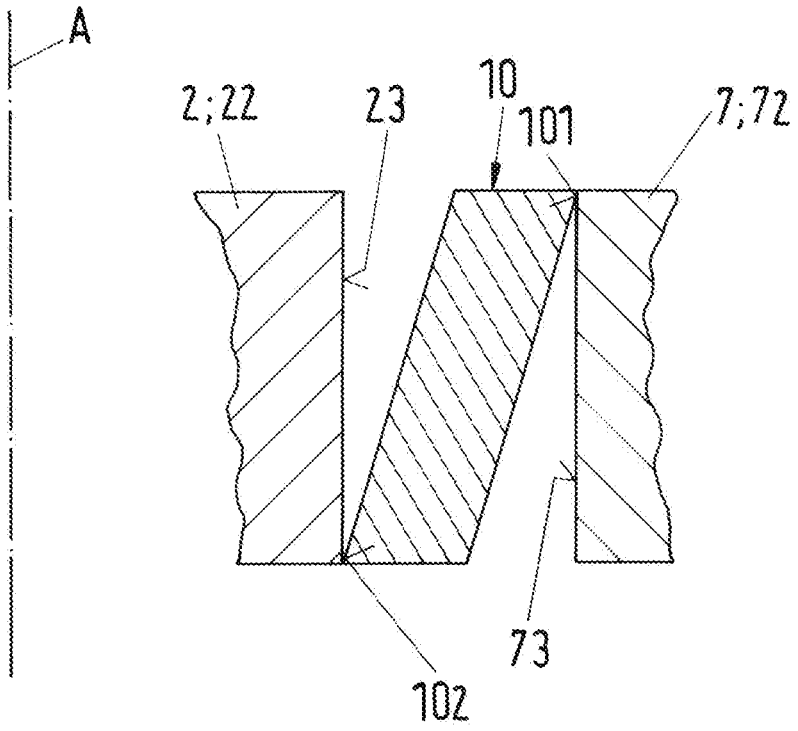
FIG. 5 is a sectional view of a first variant for the compensating element in a section along the axial direction.

For example. in FIG. 5 is illustrated a first variant for the compensating element 10, wherein the compensating element 10 is designed annularly again. In contrast to the design illustrated in FIG. 3, the first variant, illustrated in FIG. 5, has a cross-sectional area, which is substantially shaped as a parallelogram, which abuts on the guide device 7 with the first contact surface 101, and with the second contact surface at the housing 2. In this case, it may be advantageous to flatten the respective corners in order to enlarge the contact surfaces 101 or 102, respectively.

Figure 6:
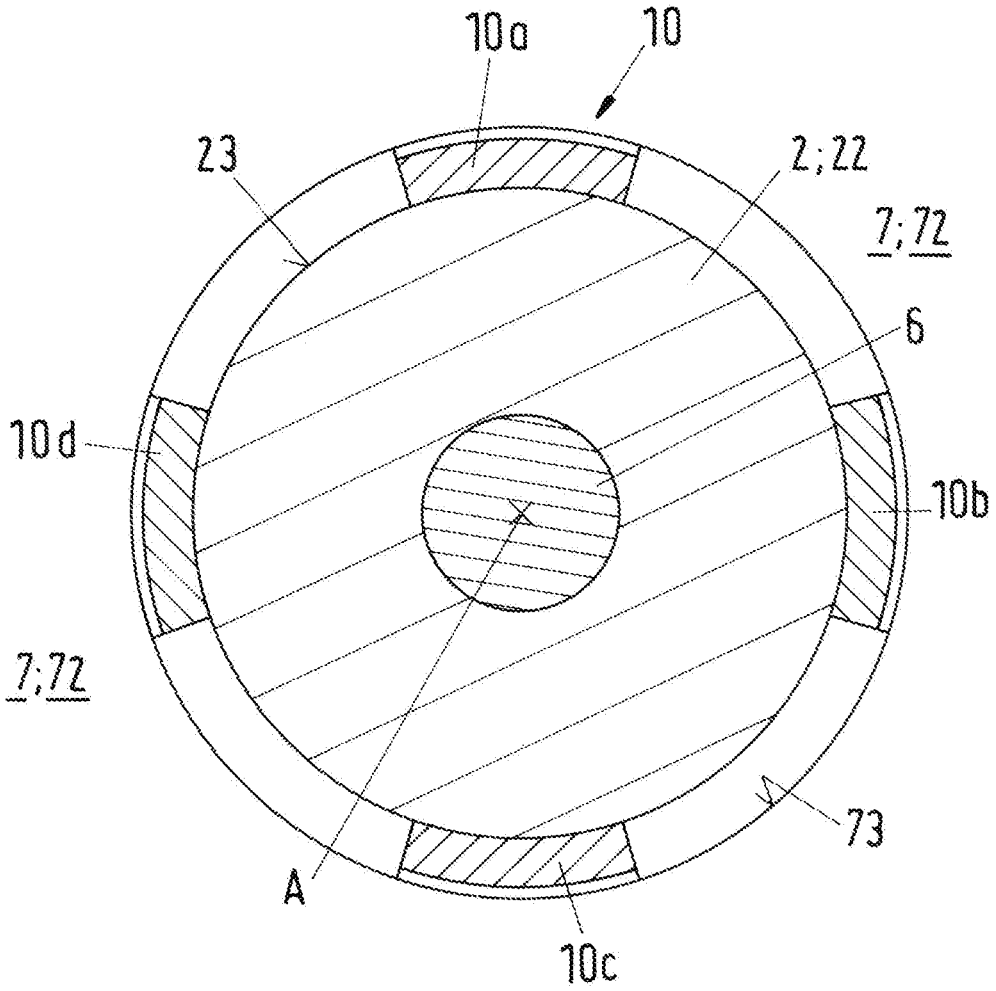
FIG. 6 is a second variant for the compensating element in a section vertical to the axial direction.

It is also by no means necessary, that the compensating element 10 is designed as a complete ring. FIG. 6 illustrates a second variant for the compensating element 10 in a section vertical to the axial direction A, wherein the section plane is in the compensating element 10. With regard to this second variant, the compensating element 10 comprises a plurality, here four, of separate segments 10*a*, 10*b*, 10*c*, 10*d*, each of them being arranged between the housing 2 and the guide device 7, wherein the segments 10*a*, 10*b*, 10*c*, 10*d* are preferably arranged symmetrically around the shaft 6. Each individual segment 10*a*, 10*b*, 10*c*, 10*d* can be, for example, designed with a cross-sectional area, which corresponds to that illustrated in FIG. 3 or in FIG. 5. Of course, other designs are also possible with respect to the cross-sectional area.

The invention claimed is:

1. A centrifugal pump for conveying a fluid, comprising:

a housing having an annular support surface, and an inlet and an outlet for the fluid, the annular support surface facing outwardly;

an impeller arranged in the housing and configured to rotate about an axial direction to convey the fluid from the inlet to the outlet;

a shaft extending in an axial direction and configured to drive the impeller;

a stationary guide having an radial annular surface, and being configured to guide the fluid from the impeller to the outlet, the stationary guide being connected to the housing, and the radial annular surface facing inwardly;

a resilient compensating element disposed between the annular support surface of the housing and the radial annular surface of the stationary guide, the resilient compensating element being arranged around the shaft and configured to hold the stationary guide in a centered position with respect to the impeller upon radial relative movement of the stationary guide relative to the housing; and a plurality of connecting elements fixing the stationary guide to the housing with respect to the axial direction, each connecting element of the plurality of connecting elements configured to enable radial relative movement between the housing and the stationary guide, and comprising a sleeve arranged in an axial bore in the housing or in the stationary guide and a fixing device extending through a central longitudinal passage in the sleeve and into an other of the housing or the stationary guide to fix the stationary guide, the central longitudinal passage disposed around an axis passing through a center of the sleeve and the sleeve having an outer diameter which is smaller than an inner diameter of the axial bore, so that an annular gap is formed between the sleeve and a wall limiting the axial bore.

2. The centrifugal pump according to claim 1, wherein the resilient compensating element is annular.

3. The centrifugal pump according to claim 1, wherein the resilient compensating element comprises a first contact surface and a second contact surface, the first contact surface abutting the stationary guide and the second contact surface abutting the housing and the first contact surface and the second contact surface are arranged offset to each other with respect to the axial direction.

4. The centrifugal pump according to claim 1, wherein the resilient compensating element comprises a first transverse leg configured to contact the stationary guide and a second transverse leg configured to contact the housing, the first transverse leg and the second transverse leg connected to each other by a longitudinal leg extending in the axial direction.

5. The centrifugal pump according to claim 1, wherein the impeller or the stationary guide is made of a different material than the housing.

6. The centrifugal pump according to claim 1, further comprising a drive unit configured to drive the impeller, the drive unit being connected to the shaft, and arranged in the housing.

7. The centrifugal pump according to claim 1, wherein the housing is a pressure housing.

8. The centrifugal pump according to claim 7, wherein the pressure housing is configured to operate at an operating pressure of at least 200 bar.

9. The centrifugal pump according to claim 1, wherein the pump is designed for a fluid having a temperature of more than 400° C.

10. The centrifugal pump according to claim 1, further comprising a drive unit arranged below the impeller with respect to a vertical direction.

11. The centrifugal pump according to claim 1, wherein the impeller is a radial impeller.

12. The centrifugal pump according to claim 1, wherein the pump is a boiler circulation pump or as an ebullating pump configured to circulate a process fluid.

13. The centrifugal pump according to claim 1, wherein each sleeve has a length in the axial direction which is larger than a length of the axial bore in which the sleeve is arranged, and each sleeve has a flange at one axial end thereof, the flange having an outer diameter which is larger than the inner diameter of the axial bore in which the sleeve is arranged.

14. The centrifugal pump according to claim 13, wherein each sleeve is configured and arranged such that in the axial direction an axial gap is formed between the flange and the housing or the stationary guide in which the axial bore is provided, so as to prevent abutting of the flange with the housing or the stationary guide.

15. A centrifugal pump for conveying a fluid, comprising:

a housing having an annular support surface, and an inlet and an outlet for the fluid, the annular support surface facing outwardly;

an impeller arranged in the housing and configured to rotate about an axial direction to convey the fluid from the inlet to the outlet;

a shaft extending in an axial direction and configured to drive the impeller;

a stationary guide having an radial annular surface, and being configured to guide the fluid from the impeller to the outlet, the stationary guide being connected to the housing, and the radial annular surface facing inwardly; and a resilient compensating element disposed between the annular support surface of the housing and the radial annular surface of the stationary guide, the annular support surface of the housing disposed radially inside of the radial annular surface of the stationary guide, the annular support surface of the housing facing in a direction away from the shaft and the radial annular surface of the guide facing in a direction of the shaft, and the resilient compensating element being arranged around the shaft and configured to hold the stationary guide in a centered position with respect to the impeller upon radial relative movement of the stationary guide relative to the housing.

16. The centrifugal pump according to claim 15, further comprising a plurality of connecting elements fixing the stationary guide to the housing with respect to the axial direction, each connecting element configured to enable radial relative movement between the housing and the stationary guide.

17. The centrifugal pump according to claim 16, wherein each connecting element comprises a sleeve arranged in an axial bore in the housing or in the stationary guide, and a fixing device configured to fix the stationary guide, the fixing device extending through the sleeve.

18. The centrifugal pump according to claim 17, wherein each sleeve has a length in the axial direction which is larger than a length of the axial bore in which the sleeve is arranged, and each sleeve has a flange at one axial end thereof, the flange having an outer diameter which is larger than the inner diameter of the axial bore in which the sleeve is arranged.

19. The centrifugal pump according to claim 18, wherein each sleeve is configured and arranged such that in the axial direction an axial gap is formed between the flange and the housing or the stationary guide in which the axial bore is provided, so as to prevent abutting of the flange with the housing or the stationary guide.

* * * * *